US006312182B1

(12) United States Patent
Dumler

(10) Patent No.: US 6,312,182 B1
(45) Date of Patent: Nov. 6, 2001

(54) BRUSH, IN PARTICULAR NAIL VARNISH BRUSH

(75) Inventor: Norbert Dumler, Ansbach (DE)

(73) Assignee: Georg Karl Geka-Brush GmbH, Bechhofen-Waizendorf (DE)

( * ) Notice: Subject to any disclaimer, the term of this patent is extended or adjusted under 35 U.S.C. 154(b) by 0 days.

(21) Appl. No.: 09/562,969

(22) Filed: May 3, 2000

(30) Foreign Application Priority Data

May 4, 1999 (DE) ..... 199 20 349

(51) Int. Cl.[7] ..... A46B 11/04
(52) U.S. Cl. ..... 401/270; 401/129; 401/282
(58) Field of Search ..... 401/34, 35, 129, 401/291, 126, 270, 268, 282, 286, 118; 15/167.1, 167.3, 186, 187, 190, 191.1, 207.2

(56) References Cited

U.S. PATENT DOCUMENTS

| | | | | |
|---|---|---|---|---|
| 1,420,563 | * | 6/1922 | McGarey | 15/207 |
| 1,674,972 | * | 6/1928 | Kendrick et al. | 401/270 |
| 2,789,298 | * | 4/1957 | Peterson | 401/270 |
| 3,093,857 | * | 6/1963 | Hersh | 401/270 |
| 4,944,625 | * | 7/1990 | Futter et al. | 401/270 |

FOREIGN PATENT DOCUMENTS

| | | |
|---|---|---|
| 467273 | 10/1928 | (DE) . |
| 8304403U1 | 9/1983 | (DE) . |
| 8625716U1 | 2/1987 | (DE) . |
| 3708984A1 | 9/1988 | (DE) . |
| 4129585A1 | 3/1993 | (DE) . |
| 19624011A1 | 12/1997 | (DE) . |
| 2342042 | 9/1977 | (FR) . |

* cited by examiner

*Primary Examiner*—David J. Walczak
(74) *Attorney, Agent, or Firm*—Browdy and Neimark

(57) ABSTRACT

In a brush for the application of a cosmetic liquid, in particular a nail varnish brush, comprising a stem with a handle section on the side of an end thereof, at least one bunch of bristles, which stands out in the axial direction, being disposed on the opposite end of the stem, it is provided that at least two bunches of bristles are provided, which, while forming a recess, are spaced from each other in a proximal portion of the stem, and which at least partially overlap in a distal portion thereof

2 Claims, 1 Drawing Sheet

BRUSH, IN PARTICULAR NAIL VARNISH BRUSH

BACKGROUND OF THE INVENTION

1. Field of the Invention

The invention relates to a brush for the application of a cosmetic liquid, in particular a nail varnish brush, comprising a stem with a handle section on the side of an end thereof, at least one bunch of bristles, which stands out in the axial direction, being disposed on the opposite end of the stem.

2. Background Art

Conventional nail varnish brushes are usually disposed on the inside of a screw cap for the nail varnish container. For the purpose of nail varnishing, the user seizes the screw cap, dips the brush into the nail varnish and applies the nail varnish stroke by stroke.

In this case problems may arise, if the supply of varnish the brush takes up when dipped in is not sufficient for varnishing a nail entirely. Then the job of applying the varnish to a nail must be interrupted and the brush must be dipped in once again. Since there is an increasing demand of the users for rapidly drying varnish, at least partial curing of the varnished part of a nail may occur so that varnishing the remaining part of the nail by the brush which has been dipped in anew may not give a clean appearance without any visible interruptions.

Another problem resides in that users will usually apply the varnish from the root of the nail to the upper edge, i.e. the brush by which to apply the varnish will cover the portion, to be varnished, of the nail so that the user's view is obstructed.

Ultimately, the user of conventional nail varnish brushes will find it hard to visually judge whether the brush still holds a supply of nail varnish sufficient to varnish another nail entirely.

DE 37 08 984 A1 teaches a nail varnish brush with a bunch of bristles being fixed in each case to two separate and spaced stems. This arrangement serves for the purpose of being dipped into specific partial supply containers for the possibility of simultaneously applying liquids for instance of varying colors.

A brush for the application of cleaning agents and lubricants is known from DE-GM 83 04 403 U1. It comprises two bunches of bristles. An opening can be provided on the front end of the stem, serving for the supply of lubricant from a supply container. To this end, the prior art brush can be slipped on a spray head.

SUMMARY OF THE INVENTION

It is an object of the invention to improve a brush of the type mentioned at the outset so as to simplify the application of varnish to the nail and to optimize the result of the varnishing job.

According to the invention, this object is attained by at least two bunches of bristles being provided, which, while forming a recess, are spaced from each other in the proximal portion of the stem and which at least partially overlap in the distal portion thereof.

As a result of this construction, the width of application per stroke is increased, which will reduce the number of joints within a single nail. The nail varnish supply capacity is increased, also the free interspace in the proximal portion being available as a supply reservoir due to the capillary action. Simultaneously, the level to which this reservoir is filled can be controlled optically and the free interspace between the at least two bunches of bristles offers a view of the surface to be varnished.

Preferably, the stem is formed by at least two tube bodies, a bunch of bristles being fixed in each tube body. The way of fixing the bristles to each of the tube bodies may be conventional, for instance by punching or by inserting prefabricated bunches of bristles.

For the provision of a further reservoir of varnish, the stem, which is hollow inside at least by sections, may be provided to have a lateral recess, through which cosmetic liquid, in particular nail varnish, may penetrate, flowing into the inner portion of the stem when dipped in and from there to the bunches of bristles.

The distal ends of the bunches of bristles may be trimmed by a joint cutting line which, in particular, is perpendicular of the joint longitudinal axis, extends at an oblique angle to the joint longitudinal axis or runs approximately in the shape of a segment of a circle in relation thereto.

Alternatively, each bunch of bristles is trimmed individually, it being possible in this way to obtain a graduation in length of two side-by-side tips.

Details of the invention will become apparent from the ensuing description of a preferred embodiment, taken in conjunction with the drawing.

DESCRIPTION OF THE PREFERRED EMBODIMENTS

Figure 3:
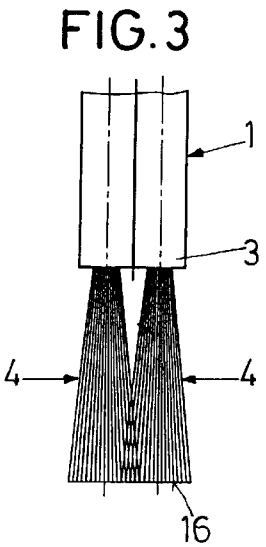
FIG. 3 is a diagrammatic view of another embodiment.

A nail varnish brush seen in the drawing comprises a handle portion 2, to which it is generally connected by a screw cap, bunches of bristles 4 being fixed to the end 3 turned away therefrom by insertion into the internally hollow stem 1 by punching.

The diameter of the bunches of bristles 4 is comparatively small in the distal portion 5, i.e. where the bunches of bristles 4 are fixed to the stem 1, and a free viewing recess 6 is formed between the bunches of bristles 4, offering the possibility of a look at the nail on the one hand and serving as a nail varnish reservoir on the other, the filling level of which can be observed visually by the user.

Figure 6:
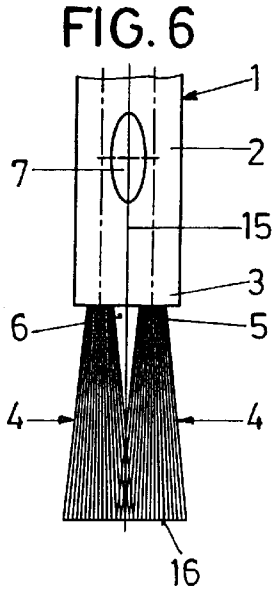
FIG. 6 is an illustration of an embodiment with a reservoir within the stem of the brush.

In the embodiment seen in FIG. 6, a recess or charging port 7 is additionally formed in the stem 1, through which nail varnish can penetrate, flowing through the internally hollow stem 1, serving as a reservoir, to the bunches of bristles 4. An openable closure (not shown) may be provided at the outlet on the underside of the reservoir. Such closure can be opened by tearing off a glued-on closure, by pushing through a thin closing skin or by pressing back a ball valve. The charging port 7 initially can be closed by welding or by a film.

Figure 1:
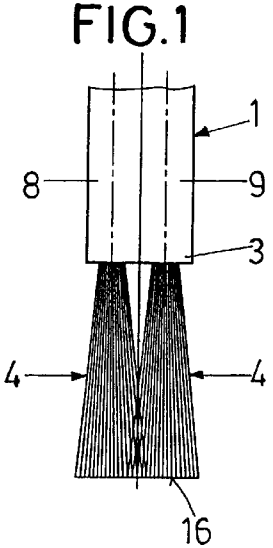
FIG. 1 is a diagrammatic illustration of a brush according to the invention with two bunches of bristles.

FIG. 1 illustrates an embodiment approximately corresponding to FIG. 6, wherein the stem 1 is formed by two intersecting tube bodies 8, 9.

Figure 4:
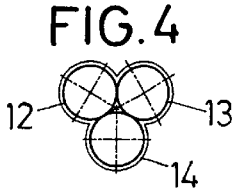
FIGS. 4 and 5 are diagrammatic sections through the stem of two possible overtures of the embodiment according to FIG. 3.
Figure 5:
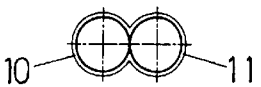
Figure 2:
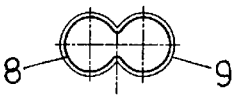
FIG. 2 is a diagrammatic section through the stem of the embodiment according to FIG. 1.

In the embodiment according to FIG. 3, the stem 1 is formed by two (FIG. 5) or three (FIG. 4) tube bodies 10, 11 and 12, 13, 14, respectively, which contact each other but are separate from one another.

In the embodiments according to FIGS. 1, 3 and 6, the bunches of bristles 4 are trimmed uniformly at right angles to the longitudinal axis 15 of the stem 1 by a straight cut 16.

Figure 7:
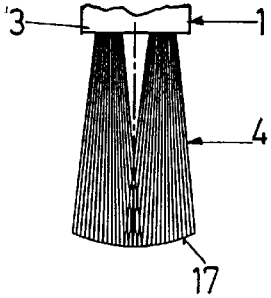
FIGS. 7 to 9 are views of various configurations in the shape of which to trim the bunches of bristles.
Figure 8:
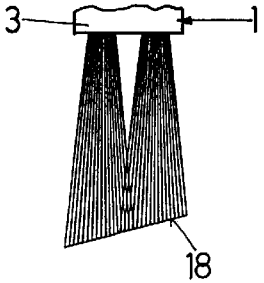

The embodiment according to FIG. 7 is provided with a uniform cut 17 in the shape of a section of a circle and the embodiment according to FIG. 8 with a straight uniform cut 18 which extends at an oblique angle to the longitudinal axis 15.

Figure 9:
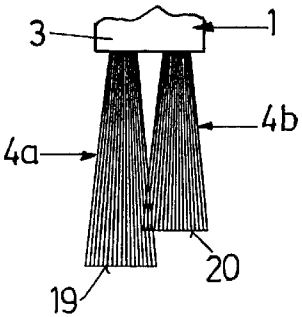

In the embodiment according to FIG. 9, each bunch of bristles 4*a* and 4*b* is trimmed individually by a cut 19 and 20, respectively, for bunches 4*a*, 4*b* of varying length to form.

Moreover, provision can be made for each individually trimmed bunch of bristles 4*a*, 4*b* to be pointed for example in the shape of a triangle, which is not illustrated in the drawing.

In keeping with a modification and further development of the embodiments mentioned above, the following possibilities of shaping are conceivable:

The bunches of bristles or the stem sections holding the bunches of bristles may be enveloped externally by a sleeve, the distance between the free front end of the sleeve and the root of the bunches of bristles ranging between 0 mm and 30 mm and the distance between the free front end and the free end of the bunches of bristles ranging between 0 mm and 60 mm.

The shapes of the stem may vary strongly, in particular the recess 6 between the bunches of bristles 4 may continue to extend as far as into the stem in a configuration that may be rectangular, in the shape of a dove tail, V-shaped, in the shape of an obtuse V, rounded, oval, or rear-recessed and oval. Also, an individual round or flat stem may be allocated to each bunch of bristles 4.

In addition to the configurations described, the bunches of bristles 4 may be trimmed in such a way that, seen in a plan view, a figure eight type configuration or a circular or oval configuration will result. Seen in a lateral view, varying graduations of rounding are conceivable, in particular a symmetric or asymmetric domed shaping.

As regards the selection of the material for the bunches of bristles, there are also various possibilities: a preferred material is Tynex PA 6.12, 6.10 or 6.6. The diameter may range from 2.0 to 8.0 mils, it being conceivable even to use bunches of bristles of varying diameter.

The cross section of the bristles may be in the shape of a round section, it may be concave or have a capillary groove and a non-circular cross section.

Polyacrylic fibers of 20 to 120 denier are also suitable for the bristles. In this case too, the above-mentioned cross sections are conceivable.

Another material for the bristles is polyester with the above-mentioned cross sections being possible. Ultimately, natural fibers come into question, for instance goat hair or mixtures.

The fibers as such may be pointed, e.g. with at least 30% pointed or split, subsequently to have an acute angle $\alpha$ in the range of 160°to 5°, the pointed portion extending over a length of 0.5 mm to 5 mm when an obtuse angle is selected, and over a length of up to 30 mm in the case of an acute angle. By alternative it is also possible for the tips to be rounded off.

What is claimed is:

1. A nail varnish applicator brush comprising an axially extending stem having a handle end and a bristle end, said bristle end having at least two bunches of bristles extending generally axially therefrom along a longitudinal axis, said at least two bunches of bristles each having an attachment end at said bristle end of said stem and a free end, said at least two bunches of bristles providing a viewing recess therebetween adjacent said attachment end, said free ends of said at least two bunches of bristles at least partially overlapping;

wherein said stem comprises a first tube body and a second tube body adjacent thereto, wherein one of said at least two bunches of bristles is fixed in said first tube body and a second of said bunch of bristles is fixed in said second tube body; and wherein said first and second tube bodies are hollow and are interconnected axially defining a hollow interior with an opening at said attachment end, and wherein said stem has at least one lateral recess for passage therethrough into said hollow interior of said stem.

2. In a method of applying a nail varnish to at least one nail with a nail varnish brush, the improvement wherein said nail varnish brush comprises an axially extending stem having a handle end and a bristle end, said bristle end having at least two bunches of bristles extending generally axially therefrom along a longitudinal axis, said at least two bunches of bristles each having an attachment end at said bristle end of said stem and a free end, said at least two bunches of bristles providing a viewing recess therebetween adjacent said attachment end, said free ends of said at least two bunches of bristles at least partially overlapping.

* * * * *